US011313634B1

(12) United States Patent
Newby et al.

(10) Patent No.: US 11,313,634 B1
(45) Date of Patent: Apr. 26, 2022

(54) MAGAZINE LOADER

(71) Applicant: MB Machine LLC, Myrtle Beach, SC (US)

(72) Inventors: Sylvan Newby, N. Myrtle Beach, SC (US); Delmar Dean Pullen, Henderson, IA (US)

(73) Assignee: MB Machine LLC, Myrtle Beach, SC (US)

( * ) Notice: Subject to any disclaimer, the term of this patent is extended or adjusted under 35 U.S.C. 154(b) by 0 days.

(21) Appl. No.: 17/379,008

(22) Filed: Jul. 19, 2021

(51) Int. Cl.
*F41A 9/83* (2006.01)

(52) U.S. Cl.
CPC ..... *F41A 9/83* (2013.01)

(58) Field of Classification Search
CPC ..... F41A 9/66; F41A 9/83
See application file for complete search history.

(56) References Cited

U.S. PATENT DOCUMENTS 9,212,859 B1 12/2015 Tal et al.
10,126,077 B1 * 11/2018 Glover ..... F41A 9/83
10,976,121 B2 4/2021 Draper
11,150,042 B2 * 10/2021 Hefer ..... F42B 39/26
2018/0202735 A1 7/2018 Draper
2018/0321004 A1 * 11/2018 Fausti ..... F41A 9/67

OTHER PUBLICATIONS

American Speedloaders LLC, printout from website, title: "Glock 9mm 40sw", accessed Jul. 9, 2021. URL: https://americanspeedloaders.com/product/glock-9mm-40sw/ Accessed Jul. 9, 2021.
Photographs of related art device disclosed in NPL citation #1. Photos taken on Jul. 9, 2021.
U.S. Appl. No. 29/800,010 of Sylvan Newby et al. (filed Jul. 19, 2021).

* cited by examiner

*Primary Examiner* — J. Woodrow Eldred
(74) *Attorney, Agent, or Firm* — Maskell Law PLLC; Benjamin E. Maskell

(57) ABSTRACT

Disclosed is a magazine loader having a base, a groove of the base, a cartridge loader slide, a channel in the cartridge loader slide, a mating portion of the cartridge loader slide sized in relative proportions to mate with the groove in the base, a magazine guide, a pin connecting the magazine guide to the cartridge loader slide; and a housing partially covering the magazine guide.

20 Claims, 9 Drawing Sheets

MAGAZINE LOADER

BACKGROUND OF THE INVENTION

Field of the Invention

The embodiments of the invention relate firearm magazine loaders, and more particularly, to a firearm magazine loader that assists a user to compresses the spring of a magazine and then insert a cartridge into the magazine. Although embodiments of the invention are suitable for a wide scope of applications, it is particularly suitable for the rapid loading of magazines for firearms.

Discussion of the Related Art

Generally, to load a magazine manually, a user must compress the spring in the magazine by forcing a rear rim of the round into the mouth of the magazine. Then when the spring is compressed, slide the rear rim of the cartridge to the back of the magazine. This action is repeated with each successive cartridge until the magazine is full. This process can be tedious, time consuming, and painful because the springs of magazines are generally stiff to ensure reliable feeding of every cartridge into the chamber of a firearm. Repeatedly loading a magazine by hand can lead to sore, cut, and chapped fingers. Those with limited dexterity may not be able to perform the precise movements required to insert a cartridge into a magazine.

The related art of magazine loaders includes a broad variety of devices that generally assist users to add cartridges to a magazine by compressing the magazine spring, inserting the cartridge, or both. One such related art loader is disclosed in U.S. Pat. No. 9,212,859 assigned to MagLula Ltd ("MagLula Patent"). The MagLula Patent discloses a sleeve that covers the opening of a magazine having a downwardly facing protrusion on the inside of the sleeve. When the sleeve is pressed down around the magazine, the protrusion compresses the magazine spring and a user can easily manually add a cartridge. The device disclosed in the MagLula Patent allows a user to use their whole hand to exert force on the magazine spring via the protrusion. This saves a user's fingers from sharp pressure associated with manually compressing the magazine spring with a cartridge.

The related art also includes U.S. Pat. No. 10,976,121 of Draper. Draper generally discloses a device to assist a user to compress a magazine spring and insert a cartridge. The Draper device includes a sliding magazine guide having a window and a cartridge slider having an arm. A cartridge can be placed on the cartridge slider. When a magazine is inserted into the magazine guide and pressed against the round, the round compresses the magazine spring. When the magazine spring is compressed, the arm slides through the window pushing the cartridge into the magazine.

There are many problems with the related art. Loaders of the style of the Maglula Patent require some dexterity. First, the bottom of the magazine needs to be placed on something firm so that the Maglula device can then be pressed against the magazine to compress the spring. Second, while the spring is compressed and while balancing the loader and magazine, a user must use a free hand to orient and deposit a cartridge into the magazine and then push the cartridge to the back of the magazine so that it is properly seeded. This balancing act and manual manipulation requires some dexterity and does not fully alleviate the inconveniences of loading standard magazines.

Draper provides a solution to the dexterity problem of the Maglula Patent, but Draper suffers many engineering problems due in part to its unnecessarily complex structure. For example, a great degree of precision is required to have two independently sliding parts work together to load a cartridge. Draper attempts to solve this problem by allowing the arm of the cartridge slide to pass through the window of the magazine guide, but this solution is prone to malfunction. Even small imprecisions can cause the arm to bind or jam on the window. Additionally, when the arm does successfully pass through the window, the arm awkwardly protrudes from the main body of the loader. Draper discloses to cover the arm with a separate cover that slidably attaches to the main body increasing the size and contributing to the awkwardness of the device. Draper's arm-through-window solution is inelegant, prone to malfunction, and cumbersome. Additionally, the precision required for the proper functioning of the Draper mechanism makes Draper not suitable for a wide variety of magazines. Instead, the Draper mechanism must be very closely sized to be compatible with specific magazines.

SUMMARY OF THE INVENTION

Accordingly, embodiments of the invention are directed to a magazine loader that substantially obviates one or more of the problems due to limitations and disadvantages of the related art.

An object of embodiments of the invention is to provide a magazine loader that assists a user to compress a magazine spring.

Another object of embodiments of the invention is to provide a magazine loader that inserts a cartridge into a magazine.

Yet another object of embodiments of the invention is to provide a magazine loader having a mechanical design suitable for low cost but high precision manufacturing.

Still another object of embodiments of the invention is to provide a magazine loader suitable for loading a variety of magazines in varying sizes and shapes.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, a magazine loader for loading a cartridge into a magazine includes a base, a groove of the base, a cartridge loader slide, a channel in the cartridge loader slide, a mating portion of the cartridge loader slide sized in relative proportions to mate with the groove in the base, a magazine guide, a pin connecting the magazine guide to the cartridge loader slide, and a housing partially covering the magazine guide.

In another aspect, a magazine loader for loading a cartridge into a magazine includes a base, a magazine guide, a spring biasing the magazine guide away from the base, a cartridge loader slide, a channel in the cartridge loader slide, the channel having a first end and a second end, a pin of the magazine guide, the pin disposed in the channel of the cartridge loader slide, wherein the cartridge loader slide is configured to translate between a first position and a second position, wherein in the first position, the pin is disposed proximate the first end of the channel, and wherein in the second position, the pin is disposed proximate the second end of the channel.

In yet another aspect, a magazine loader for loading a cartridge into a magazine includes a base, an inclined groove in the base, a cartridge loader slide, a bottom of the cartridge loader slide sized in relative proportions to be slidably received in the inclined groove, a top of the cartridge loader slide, a foot protruding from the top of the cartridge loader slide, a channel in a side of the cartridge loader slide, the channel extending from a first end at the top towards an intermediation position at the bottom, and then extending towards a second end at the foot, a magazine guide, a spring biasing the magazine guide away from the base, a pin connected to the magazine guide and slidably disposed in the channel of the cartridge loader slide, and a housing on the base slidably retaining the magazine guide.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1A:
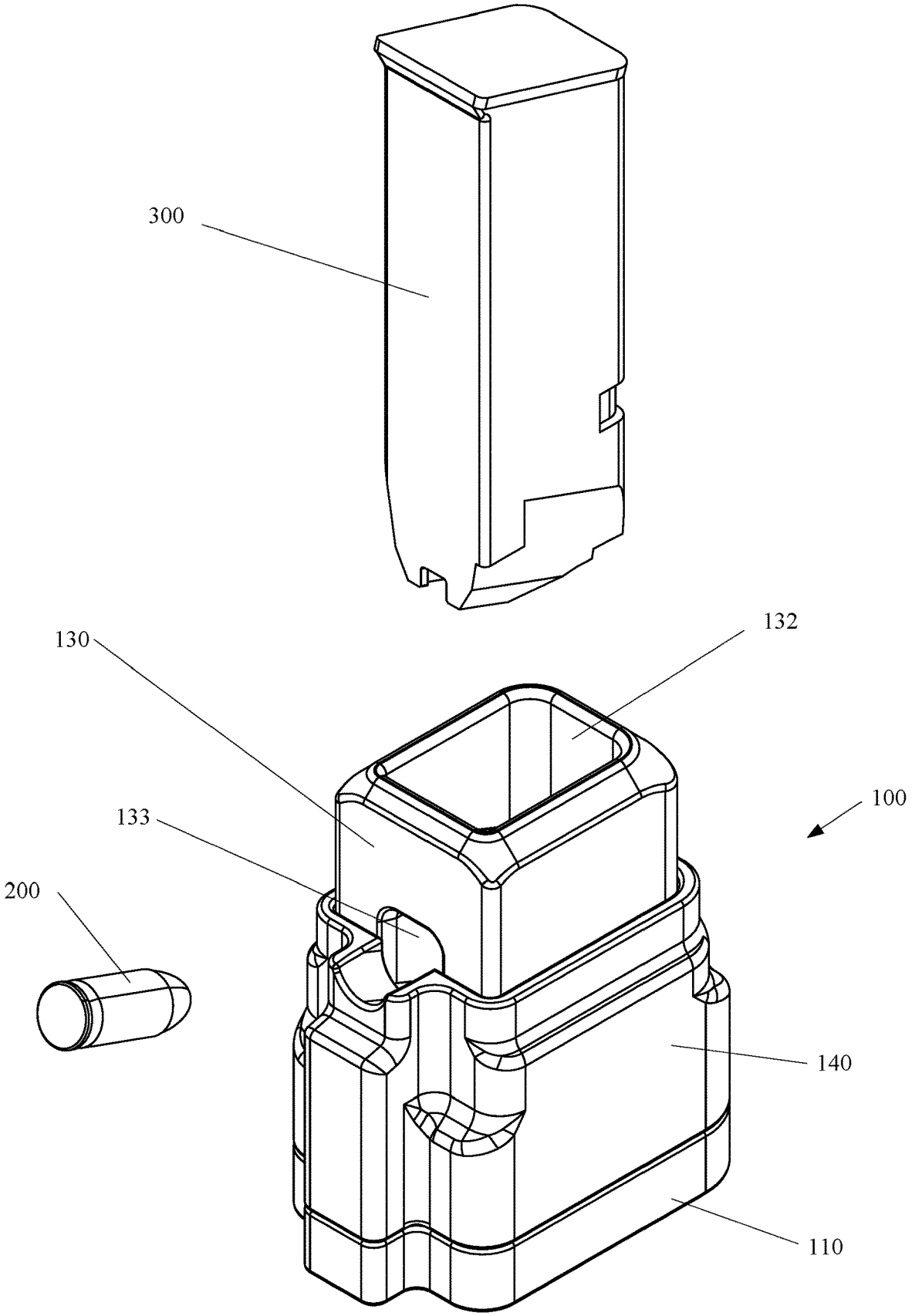
FIGS. 1A and 1B are isometric views of a magazine loader, cartridge, and magazine according to an exemplary embodiment of the invention.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

At times, this specification uses relative terms to describe the interrelation of components and to refer to portions of components. With reference to FIG. 1A, and except where context indicates otherwise, the term "top" generally refers to portion of the referenced component nearest the top of the magazine loader 100 where the magazine is to be inserted. The term "bottom" generally refers to the portion closest to or nearest the base 110. The term "front" or "front side" generally refers to the portion nearest the cartridge opening 133. The term "right" or "right side" generally refers to the side or surface to the right of the front and the term "left" or "left side" generally refers to the side or surface to the left of the front. The term "back" generally refers to the side opposite the front side. The term "down" or "downward" generally means towards the bottom while the term "up" or "upwards" generally means towards the top. The term "outside" generally refers to the outside of the referenced component and the term "inside" generally refers to the inside of the component. The term "mating" or "mating portion" generally refers to the portion of a component that is sized in relative proportions to mate or match with another component. In a general sense, a threaded hole may be a mating portion for an appropriately sized bolt. The term "opposite" generally refers to portions that are on the other side of the referenced portion. For example, the left side is opposite the right side, the front side is opposite the back side, and the top is opposite the bottom. The term "opposed" generally means facing or against the referenced portion. The term "offset" generally means spaced apart from the referenced portion. The term "slidably" means that the referenced structures can slide with respect to one another. Depending on context, the term "connected" can be directly and fixedly connected, such as with glue or mechanical fasteners. The term "connected" can also mean indirectly or non-fixedly connected such as a rotatable wheel connected to the engine of a car through the transmission. The disclosed embodiments of the invention are generally symmetrical left to right although symmetry is not a requirement or limitation of the invention. For brevity, the specification may limit discussion of symmetrical or duplicate structures where it is apparent that identical discussion would apply to such structures.

Figure 1B:
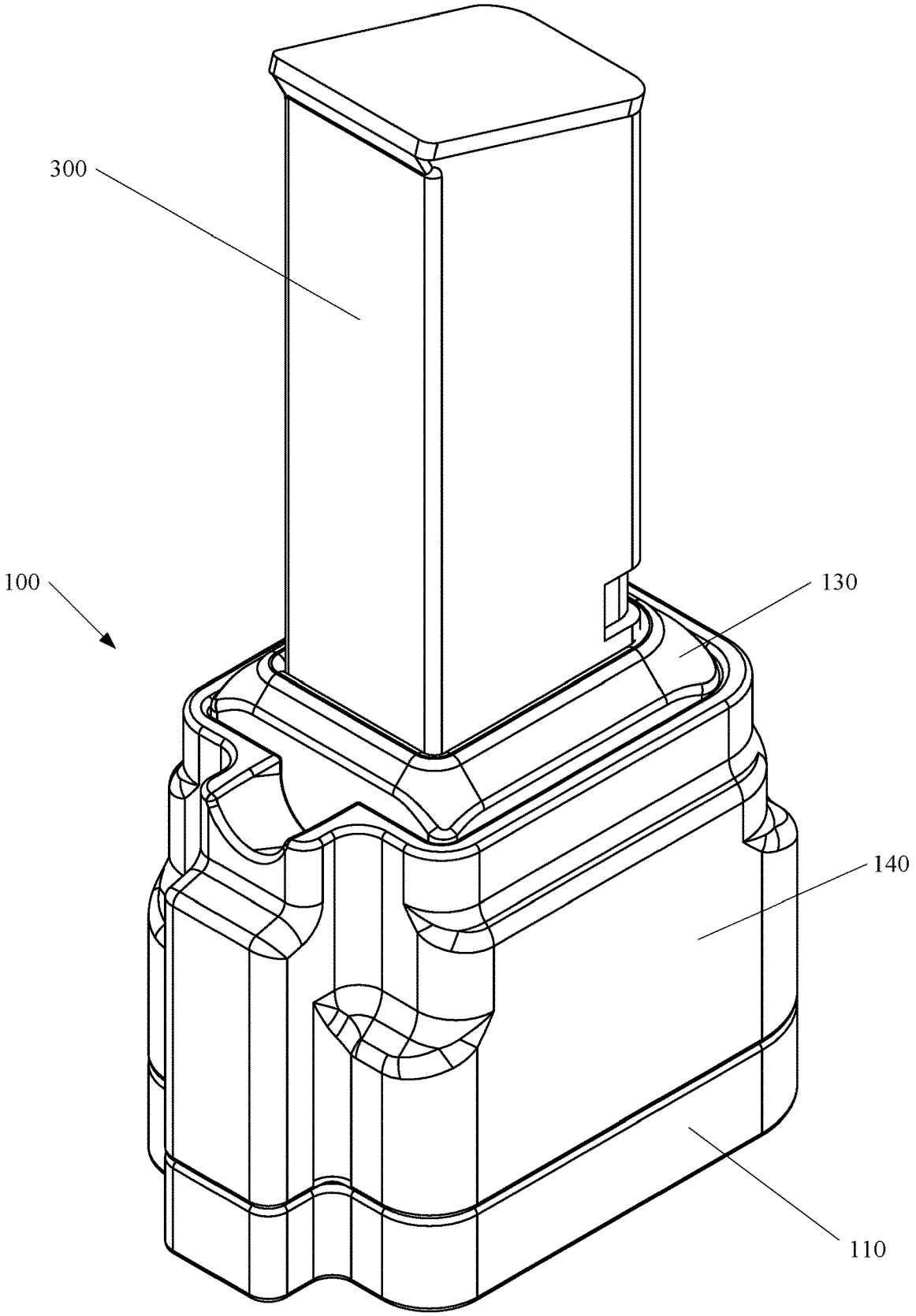

FIGS. 1A and 1B are isometric views of a magazine loader, cartridge, and magazine according to an exemplary embodiment of the invention. As shown in FIGS. 1A and 1B a magazine loader 100 includes at base 110, a housing 140, and a magazine guide 130. The magazine guide 130 can have a magazine opening 132 on the top and a cartridge opening 133 on the front. The magazine opening can be sized in relative proportions to receive a magazine 300. The cartridge opening 133 can be sized in sufficient proportions to allow a cartridge 200 to be inserted into the magazine loader 100.

FIG. 1A generally shows the magazine loader 100 in a first position ready to receive the cartridge 200 and the magazine 300. FIG. 1B generally shows the magazine loader 100 in a second position where the cartridge 200 has been inserted into the magazine loader 100 and the magazine has been pressed down into the magazine guide 130.

Figure 2:
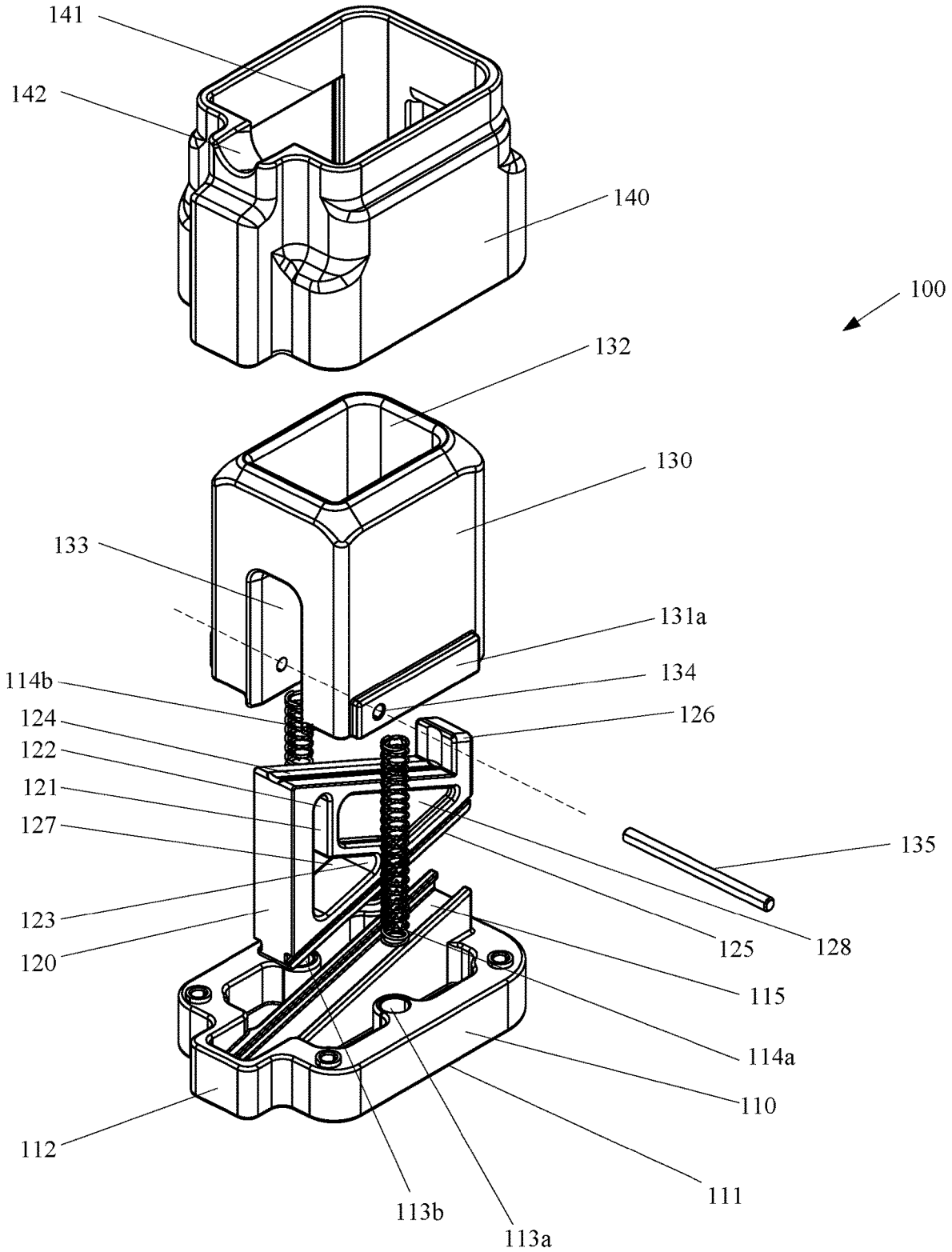
FIG. 2 is an assembly view of a magazine loader.

FIG. 2 is an assembly view of a magazine loader. As shown in FIG. 2, a magazine loader 100 can have a base 110, a cartridge loader slide 120, a magazine guide 130, and a housing 140. The base 100 can have a generally planar bottom 111, front 112, spring holes 113*a* and 113*b*, springs 114*a* and 114*b*, and groove 115. The cartridge loader slide 120 can have a channel 121, top surface 124, mating portion 125, foot 126, and recessed portion 128. The channel 121 can have a first end 122, second end 123, and intermediate position 127. The magazine guide 130 can have magazine opening 132, cartridge opening 133, boss 131*a*, pin hole 134, and pin 135. The housing 140 can have a boss catch 141 and a contoured cartridge chute 142.

The mating portion 125 of the cartridge loader slide 120 can be slidably connected to the groove 115 of the base 110. The groove 115 and mating portion 125 can be sized in relative proportions to slide with respect to one another. The groove 115 can be slightly inclined with respect to the bottom 111 of the base 110. When the cartridge loader slide 120 is slidably connected to the groove 115, a downward force exerted on the cartridge loader slide 120 can cause the cartridge loader slide 120 to translate and slide down the inclined slope of the groove 115 towards the front 112.

The top 124 of the cartridge loader slide 120 can receive a cartridge. The foot 126 can act as a stop to position the cartridge on the cartridge loader slide 120. Recessed portion 128 can make the cartridge loader slide 120 thinner and lighter. In embodiments where the cartridge loader slide 120 is made from plastic, the recessed portion 128 can ensure an approximately uniform thickness of plastic throughout the cartridge loader slide 120 and more predictable dimensional stability during cooling after injection molding.

The channel 121 can be approximately L-shaped. The channel can start at first end 122 near the top 124 of the cartridge loader slide 120. The channel 121 can extend approximately linearly downward to intermediate position 127. The channel 121 can extend from the intermediate position 127 to the second end 123. The area between intermediate position 127 and the second end 123 can be approximately triangular. In other embodiments, the area between intermediate position 127 and the second end 123 can be approximately linear. Triangularity can enable the magazine loader to be compatible with a variety of sizes of cartridges. Linearity between intermediate position 127 and the second end 123 can be used for additional precision at the expense of narrower compatibility. The distance between the first end 122 and the intermediate position 127 can be approximately the height of the cartridge. A larger intermediate position 127 can enable compatibility with a greater variety of cartridges. The distance between intermediate position 127 and the second end 123 can be approximately the distance between the front of the lips of a magazine and the backwall of the magazine. A longer distance between intermediate position 127 and the second end 123 can enable compatibility with a wider array of magazines and generally longer cartridges.

Magazine guide 130 can be connected to the cartridge loader slide 120 via pin 135 inserted in pin hole 134 and passing through the channel 121. The pin hole 134 can be disposed on boss 131*a*. The boss can reinforce the pinhole 134. In an exemplary embodiment, the pinhole 134 can completely traverse the magazine guide 130. In other embodiments, the pinhole 134 can partially traverse the magazine guide 130. Although the disclosed embodiments of the invention disclose a pin 135 and pin hole 134 for connecting magazine guide 130 and cartridge loader slide 120, other types of pins are contemplated and within the scope of the invention. For example, the magazine guide 130 may have a pin or pillar protruding from the inner surface that engages the channel 121 and similarly connects the magazine guide 130 to the cartridge loader slide 120.

The magazine opening 132 of the magazine guide 130 can be sized to receive a magazine. In one embodiment, the magazine opening 132 can be precisely sized for interoperability with a specific magazine. In other embodiments, the magazine opening 132 can be slightly oversized for interoperability with a variety of magazines.

Although the cartridge loader has been shown and described as having a channel 121 in the cartridge loader slide 120 that is connected to a pin 135 inserted in the magazine guide 130, those of skill in the art will appreciate that the channel 121 of the cartridge loader slide 120 could alternatively be formed on an inner surface of the magazine guide 130 and that a pin sized in proportion to slide within the channel could be alternatively formed on a side of the cartridge loader slide 120. Such an arrangement would have substantially the same function, operate in substantially the same way, to achieve substantially the same result and would be an equivalent of the disclosed embodiment within the scope of the invention.

The housing 140 can cover and stabilize the magazine guide 130 and cartridge loader slide 120. The housing 140 can be connected to the base 110 with screws (not shown). The housing 140 have a cartridge chute 142 to assist with guiding a cartridge into the device. The housing 140 can provide a number of benefits to the assembly. First, magazine guide 130 can be slidably received in the housing 140. The housing 140 and the magazine guide 130 can be sized in relative proportions to allow the magazine guide 130 to precisely slide within the housing 140. Boss 131*b* (FIG. 4) can catch on boss catch 141 to captively retain the magazine guide 130 within the housing 140. Boss 131*a* can catch on a symmetrical boss catch (not shown) on the opposite side of boss catch 141.

Springs 114*a* and 114*b* can bias the magazine guide 130 upwards and away from base 110. Springs 114*a* and 114*b* can be retained in spring holes 113*a* and 113*b*, respectively. The magazine guide 130 can have corresponding spring holes as shown in conjunction with FIG. 4C and FIG. 4D. In response to the force of a magazine pressing down on the magazine guide 130, the springs 114*a* and 114*b* can compress and the magazine guide 130 can slide deeper into the housing 140. In response to the force being removed, the springs 114*a* and 114*b* can expand and push the magazine guide 130 upwards until restricted by the bosses and boss catches.

In use, the embodiment of FIG. 2 can transition between at least two positions. A first position can be associated with a "ready state." In the first position, the springs 114*a* and 114*b* can bias the magazine guide 130 to the most extended and upwards position. The pin 135 connecting the cartridge loader slide 120 to the magazine guide 130 can be disposed at the first end 122 of the channel 121. The cartridge loader slide 120 can be disposed at the upward most position on the inclined groove 115. The cartridge loader slide 120 can be restricted from further upward movement in the inclined groove 115 when the cartridge loader slide 120 contacts the rear wall (not labeled) of the housing 140.

A second position can be associated with a "loaded state." In the second position, a cartridge has been positioned on the top 124 cartridge loader slide 120 and a magazine has been firmly pressed down into the opening 132 of the magazine guide 130. In the second position, the magazine guide 130 has been pushed downwards compression springs 114*a* and 114*b*, the cartridge loader slide 120 has been pushed down the inclined groove 125, and the pin 135 has moved in the channel 121 from the first end 122 to the second end 123.

In use, in transitioning between the first position and the second position, the downward force of the magazine against the cartridge and the cartridge loader slide 120 compresses the spring in the magazine allowing the cartridge to be partially inserted into the magazine. As the magazine is pressed downward, the cartridge loader slide 120 is compelled to move down the inclined groove 125 but is restrained from horizontal movement because the pin is near the first end 122 of the channel 121. As the magazine and magazine guide 130 are pushed downward, the pin 135 slides within the channel from the first end 122 to the intermediate position 127. When the pin 135 reaches the intermediate position 127, the pin 135 is cartridge loader slide 120 is no longer restricted from sliding down the inclined groove 115. The downward force of the magazine against the cartridge and ultimately against the cartridge load slide 120 pushes the cartridge load slide 120 down the inclined groove 115 and the pin 135 can slide between the intermediate position 127 and the second end 123 of the channel 121. As the cartridge loader slide 120 slides down the groove 115, the foot 126 of the cartridge loader slide 120 translates in the same direction pushing and fully seating the cartridge into the magazine. When the cartridge is fully seated, pressure can be released from the magazine, and springs 114*a* and 114*b* can return the cartridge loader 100 back to first position and ready to load a subsequent cartridge.

Figure 3B:
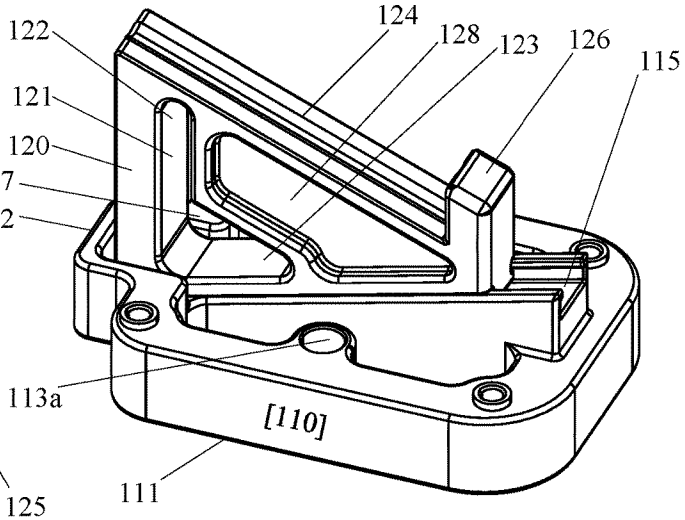
FIGS. 3A-3D are views of a base and cartridge loader slide of a magazine loader according to an exemplary embodiment of the invention.
Figure 3A:
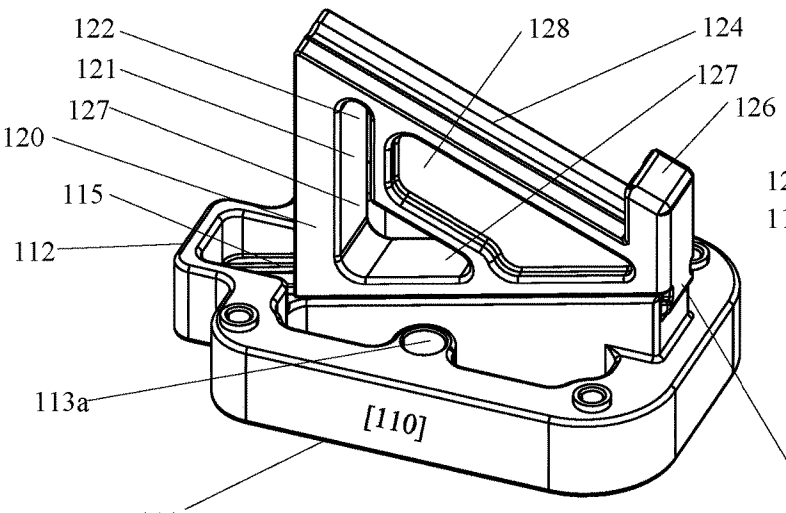
Figure 3D:
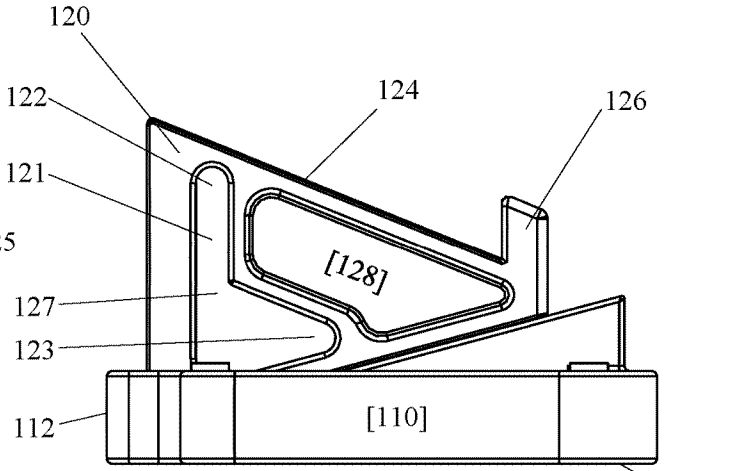
Figure 3C:
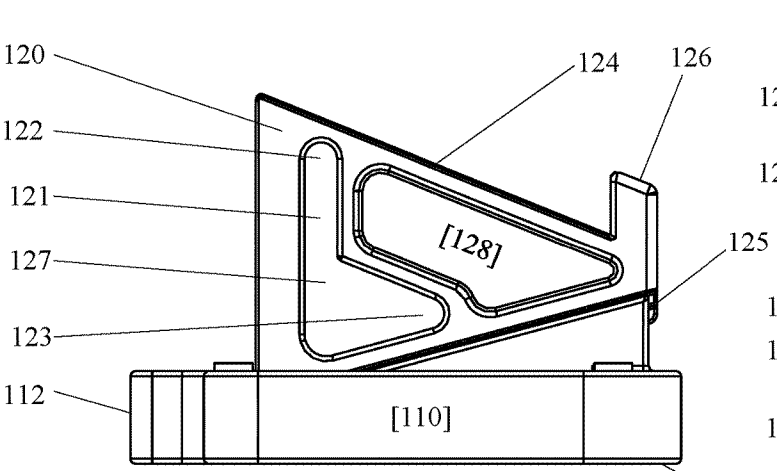

FIGS. 3A-3D are views of a base and cartridge loader slide of a magazine loader according to an exemplary embodiment of the invention. FIGS. 3A and 3C show a cartridge loader slide 120 in a first position while FIGS. 3B and 3D show a cartridge loader slide 120 in a second position. As shown in FIGS. 3A-3D, a cartridge loader slide 120 can have a channel 121 having a first end 122, second end 123, intermediate position 127, and recessed portion 128. The cartridge loader slide 120 can have a top 124, foot 126, and mating portion 125. The base 110 can have a front 112, an inclined groove 115, spring hole 113*a*, and bottom 111.

The mating portion 125 of the cartridge loader slide 120 can be sized in relative proportions to mate and slide within the groove 115 of the base 110. The cartridge loader slide 120 can slide from the first position as shown in FIGS. 3A and 3C to the second position as shown in FIGS. 3B and 3D.

The channel 121 can have a first end 122 near the top 124 of the cartridge loader slide 120 The channel 121 can extend downwards towards from the first end 122 towards the intermediate position 127. The channel 121 can extend from the intermediate position 127 to the second end 123. In an embodiment of the invention, the area between the intermediate position 127 and the second end 123 can be approximately triangular. In other embodiments, the area between the intermediate position 127 and the second end 123 can be approximately linear.

The recessed area 128 can be formed within the cartridge loader slide 120. In embodiments where the cartridge loader slide 120 is made from injection molded plastic, recessed area 128 can be sized in relative shape, size, and thickness to approximately match the thickness of other portions of the cartridge loader slide 120. Injection molded plastic can shrink and deform where varying thicknesses of materials cool at different rates. To increase precision, recessed portion 128 can increase the uniformity of thickness of materials in the cartridge loader slide 120 thereby reducing shrinking and deformation during cooling and increasing precision. Even though the recessed portion 128 reduces the width of the cartridge loader slide 120, the thinned recessed portion 128 can add support and stability to the top 124. The top 124 can be slightly concave to guide and center a cartridge. The top 124 can be slightly inclined so that the force of gravity can slide a cartridge down the incline until it contacts foot 126. In cooperation the top 124 and the foot 126 can position the cartridge for insertion into a magazine.

The width (from left to right) of the cartridge loader slide 120 can be the same as the width of upstanding walls (not labeled) forming the groove 115. An inside portion of the magazine guide 130 can be approximately same width as the cartridge loader slide 120 so that the magazine guide 130 can slide down over the cartridge loader slide 120 and the upstanding walls forming the groove 115. These proportions can increase precision of the assembled cartridge loader and prevent the components from being loose or wobbly.

FIGS. 4A-4F are views of a magazine guide of a magazine loader according to an exemplary embodiment of the invention. As shown in FIGS. 4A-4F a magazine guide 130 can have a front side 136, back side 137, left side 138, magazine opening 132, pin hole 134, bosses 131*a* and 131*b*, cartridge opening 133, rear opening 139, and wings 156. The magazine guide can have spring holes 150, recesses 151, 152, 153, and 154, right inner surface 155, and contoured guide surfaces 160 and 161. It should be appreciated that the magazine guide 130 can be substantially symmetrical and certain parts not specifically identified or completely shown can be symmetrical to other parts. For example, a right side (not shown) can be symmetrical to the left side 138, a left inner surface (not shown) can be symmetrical to the right inner surface 155, contoured guide surface 160 can be symmetrical to contoured guide surface 161.

Bosses 131*a* and 131*b* can be disposed on a left side 138 and right side of the magazine guide 130. The bosses can reinforce the lower portion of the magazine guide 130 and also cooperate with boss catch (FIG. 2, 141) to captively retain the magazine guide 130 in the housing (FIG. 2, 140).

Magazine opening 132 can be sized in relative proportions to receive a magazine for a firearm. In preferred embodiments of the invention, the magazine opening 132 is sized to be compatible with specific magazines that have similar dimensions. In other embodiments such as will be discussed in conjunction with FIGS. 6A and 6B, the magazine opening 132 is intentionally oversized and adapter pieces are provided to resize the magazine opening 132 for compatibility with a variety of sizes of magazines.

Cartridge opening 133 can form an opening to facilitate inserting a cartridge into the cartridge loader. The cartridge opening 133 can have a top wall, left wall, and right wall and be open on the bottom. In use, when a magazine is pressed into the magazine guide 130, the magazine guide 130 can slide down within the housing and the open bottom of the cartridge opening 133 can allow the cartridge opening 133 to the slide down around the cartridge loader slide. The width of the cartridge opening 133 can be approximately the width of the cartridge loader slide. Rear opening 139 can function in a similar matter to cartridge opening 133 except that rear opening 139 may not be specifically configured to allow a cartridge to be inserted into the loader. Rear opening 139 may be shorter than, or not as tall as, cartridge opening 133.

Wings 156 may project downwards from the magazine guide 130. Wings 156 can increase the surface area of the magazine guide 130 that is in contact with the cartridge loader slide when the loader is in the first position where the magazine guide is in the upward most position and the pin is in the first end of the channel of the cartridge loader slide. This increased contact surface area can contribute to increased precisions for the loader as there is a larger indexing surface between the magazine guide 130 and the cartridge loader slide. Wings 156 can additionally prevent smaller cartridges from falling off the top of the cartridge loader slide and becoming jammed in the mechanism.

Right inner surface 155 and left inner surface can be disposed between the cartridge opening 133, rear opening 139, and wings 156. The inner surfaces can be sized in relative proportions to slidably engage with the cartridge loader slide and constrain the two to substantially planar movement.

Spring holes 150 can be sized in relative proportions to receive springs (FIGS. 2, 114*a* and 114*b*). Recesses 151, 152, 153, and 154 can form hollow spaces within the sidewalls of the magazine guide 130. The recesses 151, 152, 153, and 154 can ensure that the sidewalls are approximately uniform thickness with respect to the other structures of the magazine guide 130. In embodiments where the magazine guide 130 is formed from injection molded plastic, uniform thickness can aid uniform cooling and reduce shrinking and deformation of the magazine guide 130 during manufacturing.

Pin hole 134 can extend substantially from the left side 138 through to the right side. Broken line (not labeled) is illustrates the axis of the pin hole 134. Although the pin hole is shown as extending completely through the magazine guide 130, those of skill in the art will appreciate that the pin hole 134 need not extend completely through the magazine guide and that other structures would function in the same way and achieve the same result as the combination of pin hole 134 and pin. For example, pins in the form of protrusions could be formed on the inner surfaces of the magazine guide in approximately the same location as pin hole 134 and engage in with the channel of the cartridge loader slide in the same way as the pin 135 (FIG. 2).

Contoured guide surfaces 160 and 161 can be formed near the bottom of magazine opening 132. In embodiments of the invention, the contoured guide surfaces 160 and 161 can be substantially symmetrical. The contoured guide surfaces 160 and 161 can assist to center a magazine inserted into magazine opening 132. The contoured guide surfaces 160 and 161 can serve as a stop for a magazine inserted into magazine opening 132. When a magazine is pressed into the magazine opening 132, the magazine can push against contoured guide surfaces 160 and 161 and, in turn, push the magazine guide 130 down into the housing and around the cartridge loader slide. The contoured guide surfaces 160 and 161 can be contoured to approximately match the shape of a corresponding portion of a specific magazine or a variety of different magazines.

Figures 5A, 5B, 5C:
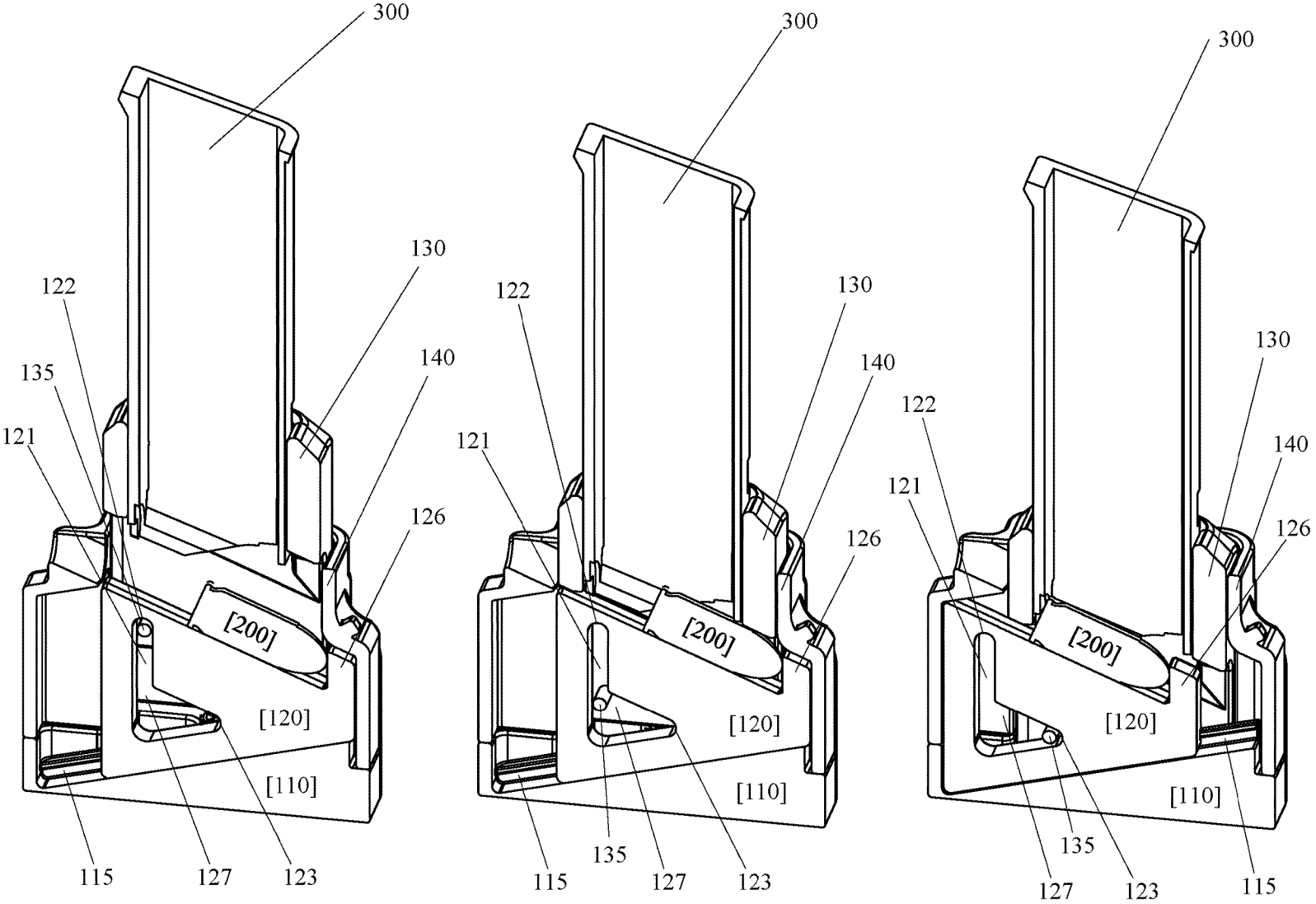
FIGS. 5A-5C are cross-sectional views of a magazine loader in operation according to an exemplary embodiment of the invention.

FIGS. 5A-5C are cross-sectional views of a magazine loader in operation according to an exemplary embodiment of the invention. FIG. 5A is a cross section of a magazine loader in a first position, FIG. 5B is a cross section of a magazine loader in an intermediate position, and FIG. 5C is a cross section of a magazine loader in a second position. The magazine spring and follower have been omitted for clarity of illustration but those of skill in the art will appreciate their position and function, even if not shown.

As shown in FIG. 5A, the magazine loader is in a first position. A cartridge 200 is resting against the foot 126 of the cartridge loader slide 120. A magazine 300 has been inserted in the magazine guide 130. The magazine guide 130 is disposed in its upward-most position in the housing 140. The cartridge loader slide 120 is in an upward-most position in the inclined groove 115 in the base 100. The pin 135 is in the first end 122 of the channel 121.

Figure 4B:
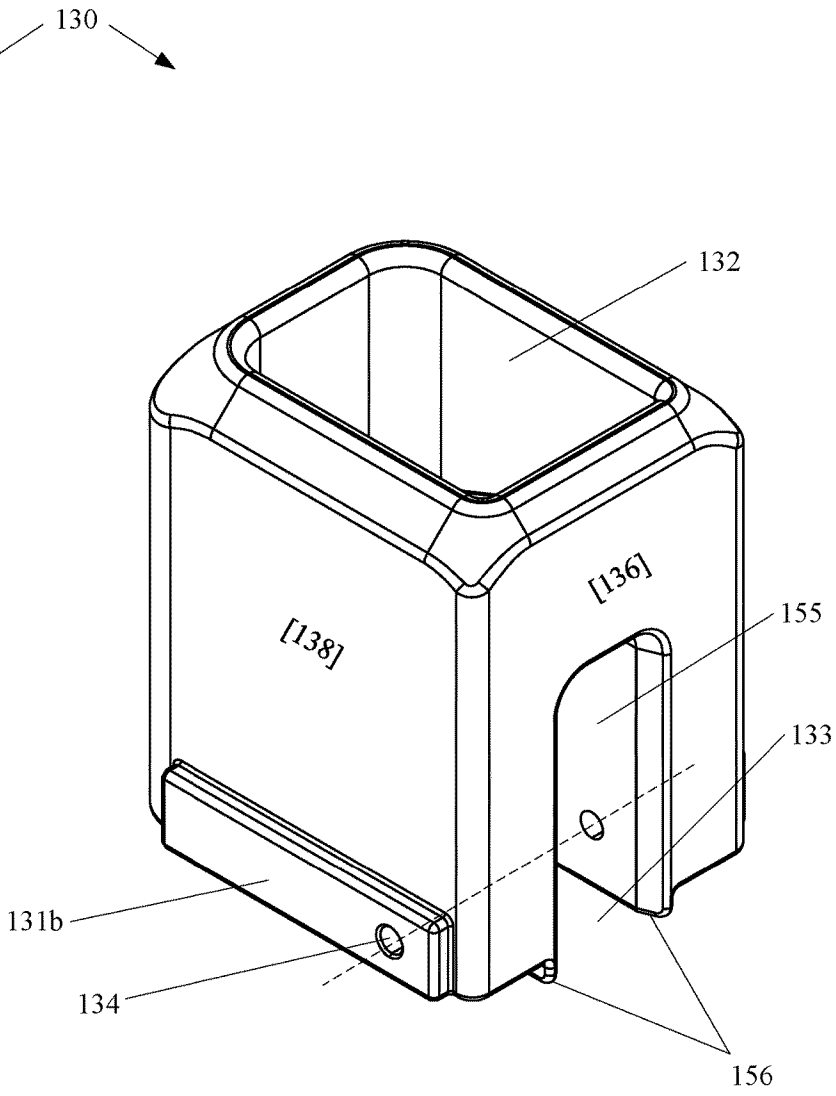
FIGS. 4A-4F are views of a magazine guide of a magazine loader according to an exemplary embodiment of the invention.
Figure 4A:
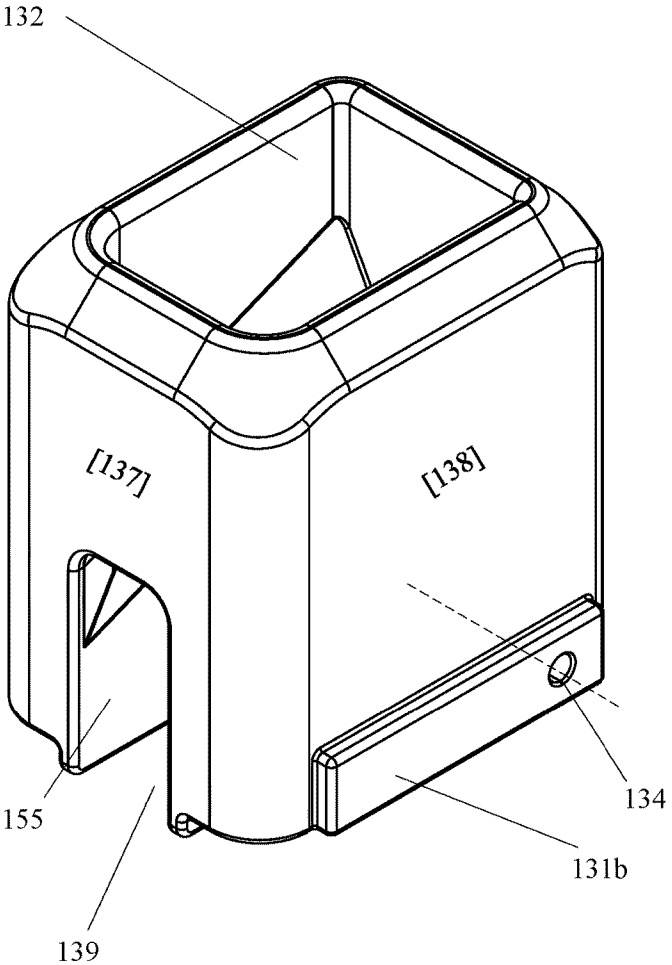
Figure 4D:
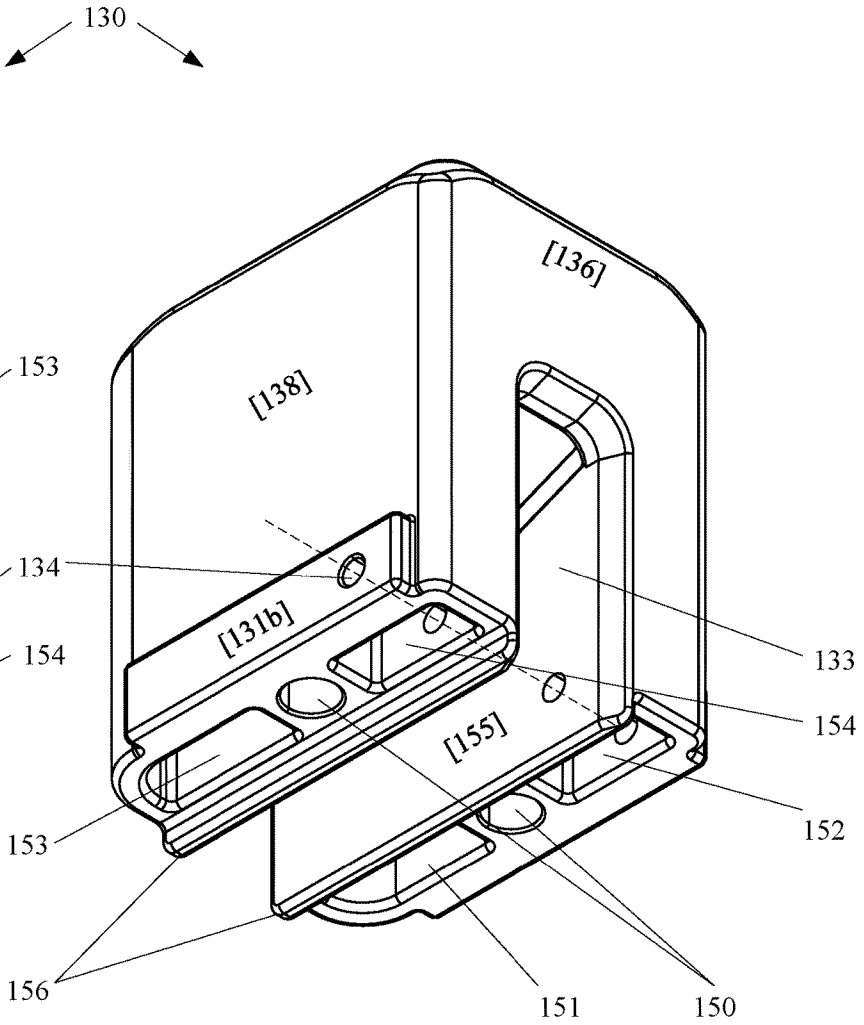
Figure 4C:
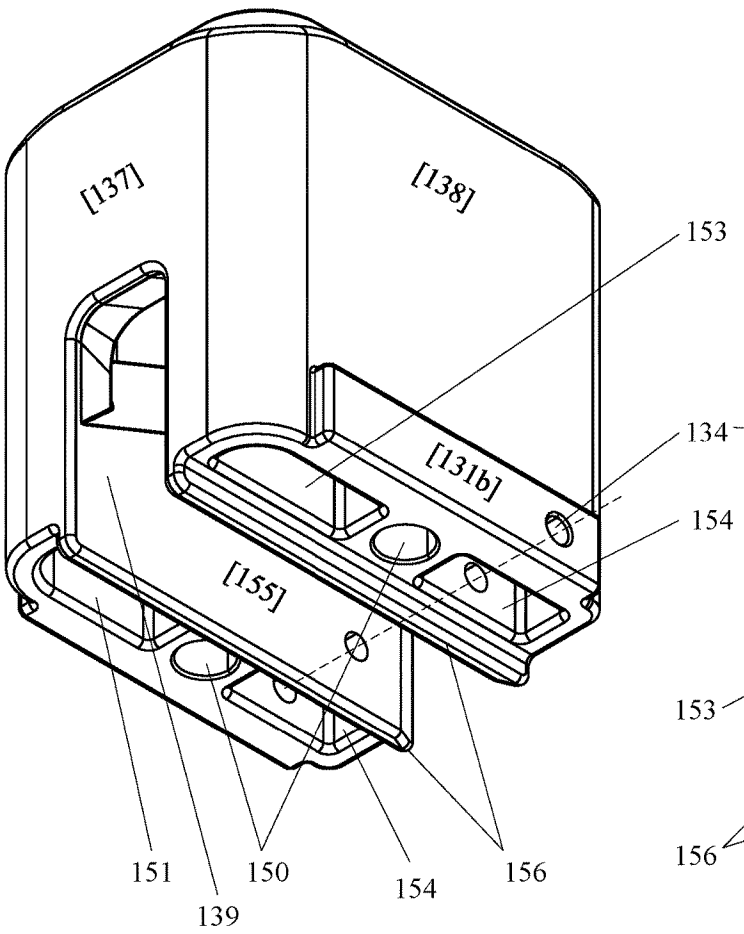
Figure 4F:
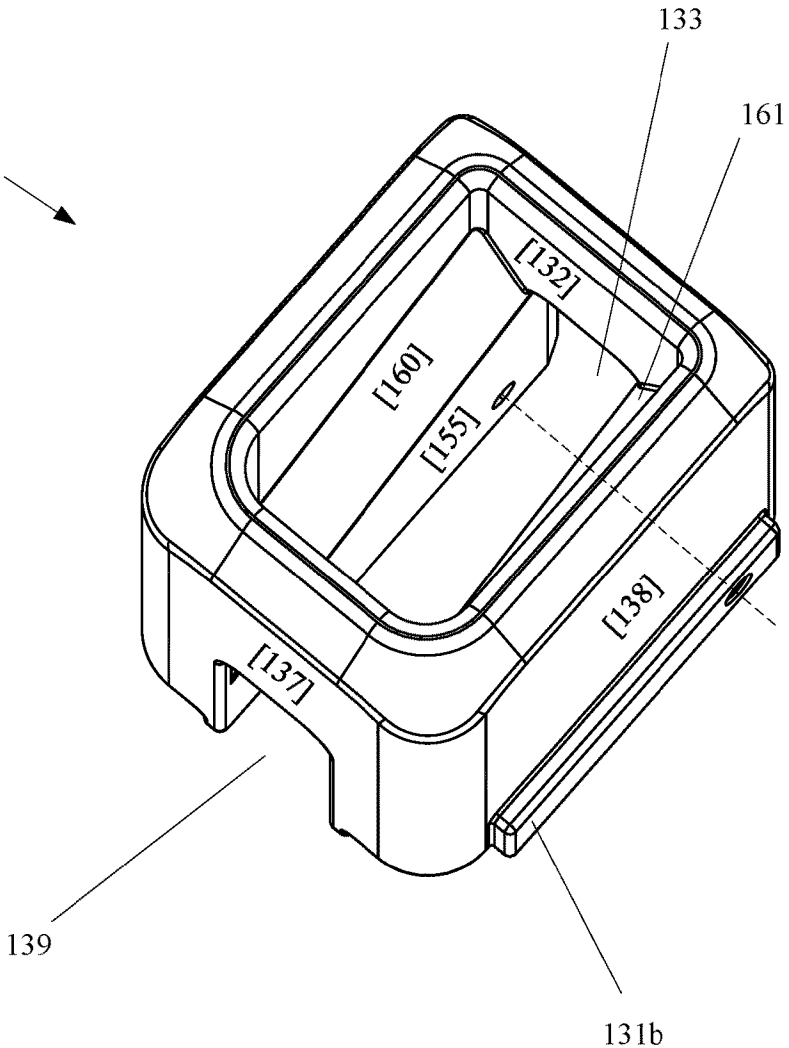
Figure 4E:
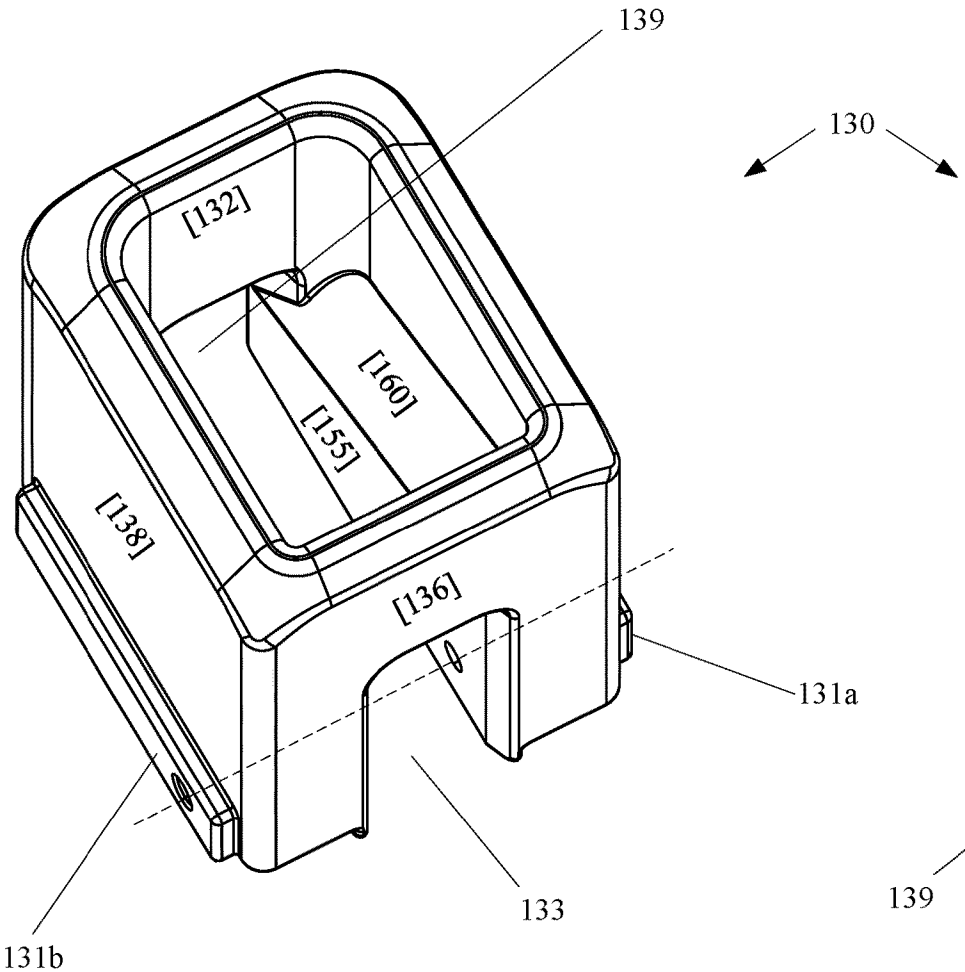

As shown in FIG. 5B, the magazine loader is in an intermediate position. In the intermediate position, the magazine 300 has been pressed down into the magazine guide 130 and into the contoured guide surfaces 160 and 161 (FIGS. 4E and 4F). Pushing the magazine 300 into the magazine guide 130 has two substantial effects. First, the pin 135 has translated from the first end 122 of the channel 121 to the intermediate position 127. In the intermediate position 127, the cartridge loader slide 120 is no longer constrained from lateral movement by the pin 135 in the channel 121. Second, the cartridge 200 has compressed the spring and follower (not shown) of the magazine 300. The cartridge 200 is now partially inserted into the magazine 300 and needs only a push to fully seat the cartridge in the back of the magazine.

In FIG. 5C, the magazine 300 is continued to be pushed into magazine guide and the cartridge loader slide 120, no longer constrained from lateral movement by pin 135, has slide down inclined groove 115 and the pin is now disposed in the second end 123 of the channel 121. While sliding down inclined groove 115 of the base 110, the foot 126 has pushed the cartridge into the magazine and fully seated the cartridge 200 in the back of the magazine 300.

When downward pressure is removed from the magazine 300, springs bias the magazine guide 130 upwards and the aforementioned process can happen substantially in reverse except that the cartridge can be frictionally retained in the magazine. In reverse, the pin 135 slides from the second end 123 back to the intermediate position 127 and, in doing so, forces the cartridge loader slide 120 back up the inclined groove 115. Once in the intermediate position 127, the pin slides up the channel 121 to the first end 122. The loader is now reset and a subsequent cartridge can be inserted for loading.

Figures 6A, 6B:
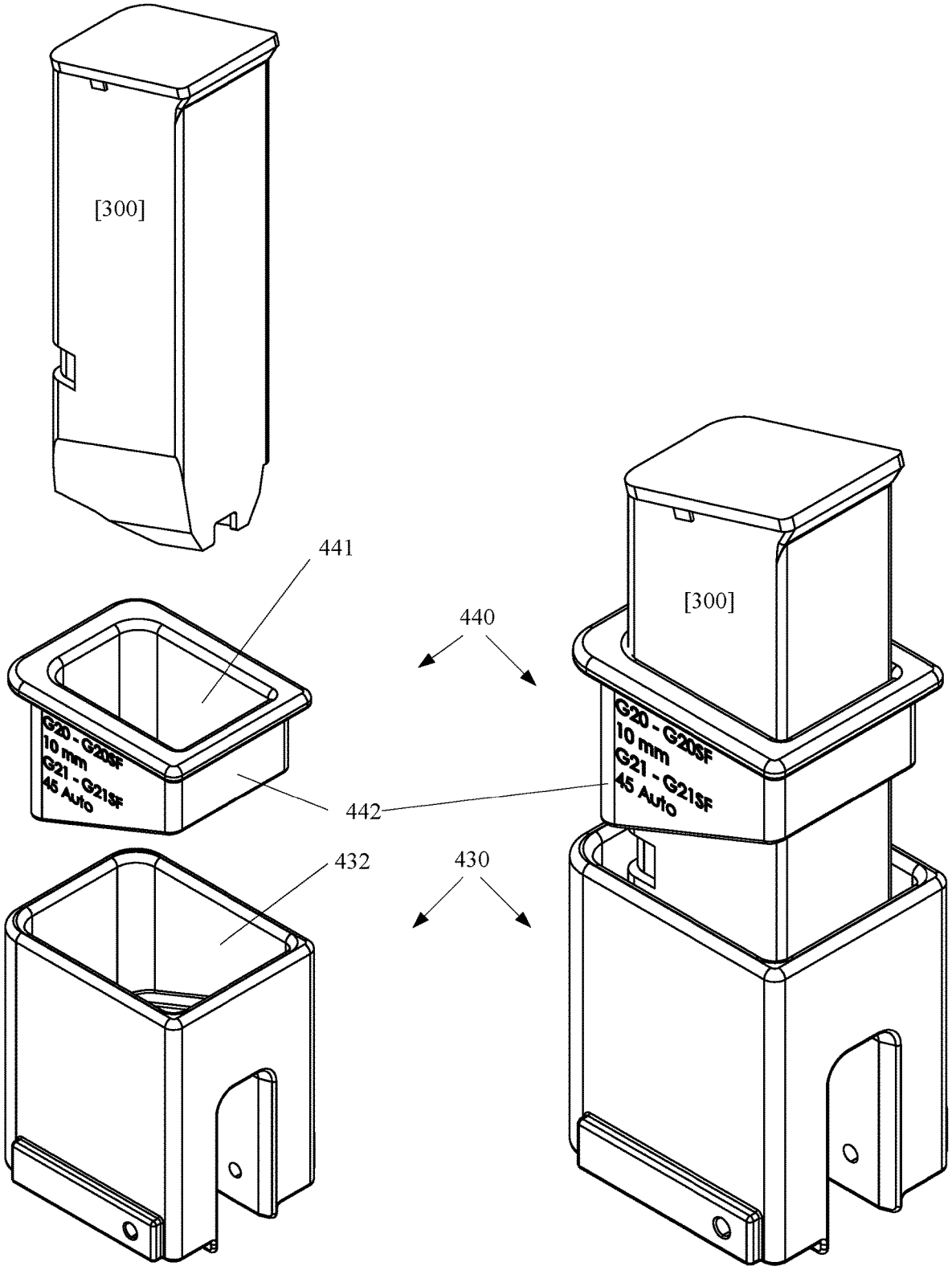
FIG. 6A and FIG. 6B are views of a magazine guide, adapter sleeve, and magazine according to an exemplary embodiment of the invention.

FIG. 6A and FIG. 6B are views of a magazine guide, adapter sleeve, and magazine according to an exemplary embodiment of the invention. As shown in FIGS. 6A and 6B a magazine guide 430 can have an opening 432. The opening 432 can be sized in relative proportions to receive an adapter piece 440. The adapter piece 440 can have an inner surface 441 and an outer surface 442. The inner surface 441 of the adapter piece 440 can be sized in relative proportions to receive certain types of magazines such as magazine 300. The outer surface 442 of adapter piece 440 can be sized in relative proportions to be snugly received in the opening 432 of magazine guide 430. By using adapter pieces such as adapter piece 440, a single magazine guide 430 can be sized for compatibility with a wide variety of magazines. Adapter pieces may be cost effectively formed from injection molded plastic. Commercial embodiments of the invention may be sold including a variety of adapter pieces to ensure wide compatibility of the loader with common, commercially available magazines. The adapter piece 440 can center and advantageously position the magazine 300 within the magazine guide 430. Except for the addition of the adapter piece 440, the magazine guide 430 can function in the same way as the magazine guide 130 shown and described in conjunction with FIG. 1 through FIG. 5C.

It will be apparent to those skilled in the art that various modifications and variations can be made in the magazine loader without departing from the spirit or scope of the invention. Thus, it is intended that embodiments of the invention cover the modifications and variations of this invention provided they come within the scope of the appended claims and their equivalents.

What is claimed is:

1. A magazine loader for loading a cartridge into a magazine, comprising:

a base;

a groove of the base;

a cartridge loader slide;

a channel in the cartridge loader slide;

a mating portion of the cartridge loader slide sized in relative proportions to mate with the groove in the base;

a magazine guide;

a pin connecting the magazine guide to the cartridge loader slide; and a housing partially covering the magazine guide.

2. The magazine loader of claim 1 wherein the pin connects to the channel of the cartridge loader slide.

3. The magazine loader of claim 1 wherein the magazine guide is slidably retained in the housing.

4. The magazine loader of claim 1 further comprising:

a boss on the magazine guide captively retaining the magazine guide within the housing.

5. The magazine loader of claim 1 wherein the mating portion of the cartridge loader slide is slidably mated with the groove in the base.

6. The magazine loader of claim 1 wherein the groove is inclined with respect to the base.

7. The magazine loader of claim 1 further comprising:

an adapter sleeve having an inside surface for receiving the magazine and an outside surface for mating with the magazine guide;

wherein the outside surface of the adapter sleeve is sized in relative proportions to be received in the magazine guide; and wherein the inside surface of the adapter sleeve is sized in relative proportions to receive the magazine.

8. The magazine loader of claim 1 further comprising:

a pair of wings extending from the magazine guide.

9. A magazine loader for loading a cartridge into a magazine, comprising:

a base;

a magazine guide;

a spring biasing the magazine guide away from the base;

a cartridge loader slide;

a channel in the cartridge loader slide, the channel having a first end and a second end;

a pin of the magazine guide, the pin disposed in the channel of the cartridge loader slide;

wherein the cartridge loader slide is configured to translate between a first position and a second position;

wherein in the first position, the pin is disposed proximate the first end of the channel; and wherein in the second position, the pin is disposed proximate the second end of the channel.

10. The magazine loader of claim 9 wherein in response to a force exerted by the cartridge against the cartridge loader slide, the cartridge loader slide translates from the first position to the second position; and wherein in response to the force being removed, the cartridge loader slide translates from the second position back to the first position.

11. The magazine loader of claim 9 further comprising:

a top of the cartridge loader slide;

a foot protruding from the top of the cartridge loader slide.

12. The magazine loader of claim 9 further comprising:

a housing over base;

a boss of the magazine guide; and wherein the boss of the magazine guide captively retains the magazine guide within the base.

13. The magazine loader of claim 9 further comprising:

a boss of the magazine guide;

a pin-hole in the boss;

wherein the pin is disposed in the pin-hole.

14. The magazine loader of claim 9 further comprising:

a groove in the base;

a bottom of the cartridge loader slide, the bottom of the cartridge loader slide sized in relative proportions to be slidably received in the groove of the base.

15. The magazine loader of claim 9 further comprising:

an adapter sleeve having an inside surface for receiving the magazine and an outside surface for mating with the magazine guide;

wherein the outside surface of the adapter sleeve is sized in relative proportions to be received in the magazine guide; and wherein the inside surface of the adapter sleeve is sized in relative proportions to receive the magazine.

16. The magazine loader of claim 9 further comprising:

a pair of wings extending from the magazine guide.

17. A magazine loader for loading a cartridge into a magazine, comprising:

a base;

an inclined groove in the base;

a cartridge loader slide;

a bottom of the cartridge loader slide sized in relative proportions to slidably mate with the inclined groove;

a top of the cartridge loader slide;

a foot protruding from the top of the cartridge loader slide;

a channel in a side of the cartridge loader slide, the channel extending from a first end at the top towards an intermediation position at the bottom, and then extending towards a second end at the foot;

a magazine guide;

a spring biasing the magazine guide away from the base;

a pin connected to the magazine guide and slidably disposed in the channel of the cartridge loader slide; and a housing on the base slidably retaining the magazine guide.

18. The magazine loader of claim 17 wherein the cartridge loader slide translates between a first position and a second position;

wherein in the first position the pin is disposed in the first end of the channel;

wherein in the second position the pin is disposed in the second end of the channel;

wherein the spring biases the cartridge loader slide in the first position;

wherein when in the first position and in response to a force pressing the cartridge into the cartridge loader slide, the pin slides between the first end of the channel and the intermediation position, and then, when the pin reaches the intermediate position, the cartridge loader slide translates with respect to the base such that the pin of the magazine guide is disposed in the second end of the channel.

19. The magazine loader of claim 18 wherein, in response to removing the force, the spring biases the cartridge loader back to the first position.

20. The magazine loader of claim 18 wherein, when the cartridge loader slide translates with respect to the base, the foot of the cartridge loader slide pushes the cartridge into the magazine.

* * * * *